US010633166B2

(12) United States Patent
Elkordy

(10) Patent No.: US 10,633,166 B2
(45) Date of Patent: Apr. 28, 2020

(54) FOOD CONTAINER ASSEMBLY

(71) Applicant: Amani Elkordy, Great Falls, VA (US)

(72) Inventor: Amani Elkordy, Great Falls, VA (US)

( * ) Notice: Subject to any disclaimer, the term of this patent is extended or adjusted under 35 U.S.C. 154(b) by 0 days.

(21) Appl. No.: 15/950,397

(22) Filed: Apr. 11, 2018

(65) Prior Publication Data

US 2018/0290816 A1 Oct. 11, 2018

Related U.S. Application Data

(60) Provisional application No. 62/484,084, filed on Apr. 11, 2017.

(51) Int. Cl.

| | |
|---|---|
| ***B65D 83/00*** | (2006.01) |
| ***B65D 75/52*** | (2006.01) |
| ***B65D 77/04*** | (2006.01) |
| ***B65D 77/06*** | (2006.01) |
| *B65D 35/08* | (2006.01) |
| *A47G 21/04* | (2006.01) |
| *A47G 21/00* | (2006.01) |
| *B65D 51/24* | (2006.01) |
| *B65D 75/58* | (2006.01) |
| *B65D 33/25* | (2006.01) |
| *B65D 55/16* | (2006.01) |

(52) U.S. Cl.

CPC ..... *B65D 83/0055* (2013.01); *B65D 75/525* (2013.01); *B65D 77/04* (2013.01); *B65D 77/06* (2013.01); *A47G 21/004* (2013.01); *A47G 21/04* (2013.01); *B65D 33/2508* (2013.01); *B65D 35/08* (2013.01); *B65D 51/246* (2013.01); *B65D 55/16* (2013.01); *B65D 75/5805* (2013.01); *B65D 2231/001* (2013.01); *B65D 2583/005* (2013.01)

(58) Field of Classification Search

CPC . A61J 7/0023; B65D 83/0055; B65D 75/525; B65D 75/5805; B65D 77/04; B65D 77/06; B65D 25/18; B65D 2583/005; A47G 21/04; A47G 21/004

USPC ..... 222/95–106

See application file for complete search history.

(56) References Cited

U.S. PATENT DOCUMENTS 4,020,978 A * 5/1977 Szczepanski ..... B05B 11/046 222/209

4,657,151 A * 4/1987 Cabernoch ..... A61J 9/001 215/11.6

(Continued)

*Primary Examiner* — Charles Cheyney

(74) *Attorney, Agent, or Firm* — Scott D. Balderston

(57) ABSTRACT

Embodiments relate to a food container assembly having a removable internal dispensing bag or enclosure. Food product(s) such as baby food, liquids or other product(s) or material can be loaded and/or stored in the internal enclosure, which is then enclosed within an external protective enclosure, with an opening for access to product(s) stored in the internal enclosure. Straws, spoons, or other utensils can be used. The external enclosure can include snap fits or other connections to enclose the external enclosure around the internal enclosure, so that the internal enclosure can be accessed and removed for washing, reloading of food, or other handling. The external enclosure or other bag or enclosure can include a pocket for an ice pack or insulation. The external enclosure can protect against mold, fungus, or other spoilage or contamination, and can be used repeatedly to enclose bags storing various food products.

13 Claims, 8 Drawing Sheets

(56) References Cited

U.S. PATENT DOCUMENTS 4,842,165 A * 6/1989 Van Coney ..... B65D 47/2018 222/105
4,888,188 A * 12/1989 Castner, Sr. ..... A47G 19/183 426/109
5,137,183 A * 8/1992 Mikulec ..... A61J 7/0023 222/192
5,154,318 A * 10/1992 Lampard ..... A61J 7/0023 222/105
5,398,848 A * 3/1995 Padamsee ..... A45F 3/20 222/105
5,540,357 A * 7/1996 Malofsky ..... B05C 17/00546 219/759
5,669,529 A * 9/1997 Levit ..... A45C 1/04 222/105
6,510,965 B1 * 1/2003 Decottignies ..... B05B 11/00412 222/95
7,121,431 B2 * 10/2006 Duke ..... B65D 75/5883 222/183
8,087,546 B2 * 1/2012 Rabinovitch ..... B65D 55/10 222/105
8,459,504 B2 * 6/2013 Braxton ..... A47G 21/004 222/106
8,690,025 B2 * 4/2014 Kojima ..... B65D 23/0857 222/105
8,807,377 B2 * 8/2014 Corbett ..... B65D 77/06 220/495.03
2005/0029285 A1 * 2/2005 Gay, III ..... G01F 11/082 222/1
2006/0230588 A1 * 10/2006 Sprehe ..... A61J 9/001 24/585.12
2008/0142545 A1 * 6/2008 Priolo ..... B65D 25/16 222/105
2012/0168461 A1 * 7/2012 Topits ..... B65D 47/0804 222/105
2015/0024085 A1 * 1/2015 McBean ..... A61J 11/04 426/2
2015/0158042 A1 * 6/2015 Parker ..... B05B 11/048 222/175
2016/0090220 A1 * 3/2016 James ..... B65D 47/305 222/173

* cited by examiner

FOOD CONTAINER ASSEMBLY

CROSS-REFERENCE TO RELATED APPLICATION

This application claims benefit, including priority, of U.S. Provisional Application Ser. No. 62/484,084 filed Apr. 11, 2017, entitled "Food Container," by the same inventor herein, which application is incorporated by reference in its entirety.

FIELD

The present teachings relate to a food container assembly, and more particularly, to a food container assembly consisting of multiple bags or enclosures constructed in a nested, encapsulated, and/or bag-within-bag fashion for reusable food storage, cleaning, handling, preparation, and dispensing.

BACKGROUND

In the field of food packaging and handling, it has been known to use portable or disposable food containers to store and dispense soft foods and other food products or material to infants, children, medical patients, and others.

A single bag container, as conventionally known, can be pre-packaged or later filled with liquids, mashed foods, or other soft food product(s) or other food product(s) or material, for instance to permit an infant or child to access the food product through an opening, straw, spout, spoon, or other conduit. In general, such single-bag containers are made of plastic or other inert material, to attempt to enhance the sanitary nature of the storage container, and are in part designed to permit parents and other caregivers to conveniently purchase and deliver food products to infants, children, medical patients, or others in pre-packaged amounts.

However, in known food packaging constructions of these kinds, issues related to sanitation and food wastage may arise. For instance, if the child, infant, or other consumer does not consume the entire container of food, the parent or other caregiver may attempt to store the bag with the remaining food for later use, for example by placing the container in a refrigerator. Storage in a refrigerator or other location may, however, produce fungus, mold, or other spoilage of the remaining food due to oxygen exposure, exposure to moisture, fermentation, and/or other contamination, factors, or processes.

Knowing that the left over food product may not "keep," or be able to be preserved, the parent or other caregiver may choose to throw leftover food product away, possibly wasting food product. Attempting to remove leftover food product and then washing the bag is generally time consuming and not practical, effective, or possible. The difficulty in cleaning a single-ply or similar bag for later reuse may lead to mold or fungus growing within the crevices or other areas of the bag which may be unreachable to clean or impossible to remove. Along with causing frustration, parents unaware of mold growth may expose their children to health hazards.

Thus a multi-part assembly including a disposable internal lining which can be effectively cleaned or thrown out after use may be desirable to address these problems and others, as well as require little or minimal cleaning of the outermost or external bag. Also, once left over food is removed from the disposable or internal bag or enclosure, it can be placed in separate air-tight rigid or other container for safer or longer-term storage. Additionally, left over food can be kept for future use within the disposable or internal bag by closing the opening. Furthermore, to avoid food waste, the external enclosure or cover may be insulated through an insulating material or via an air insulated cavity between both enclosures to allow food products to stay warm or cold for several hours. This would allow food items such as yogurts to stay cold, while at the same time foods such as soups can stay warm.

It may therefore again to be desirable to provide an advanced, multi-part, nested food container assembly, in which food product(s) or materials can be safely, conveniently, and sanitarily stored within a removable inner lining or internal dispensing bag or enclosure nested within a surrounding protective outer cover or enclosure, to allow the removal or food, the loading or insertion of food product, refrigeration, food loading, container cleaning and re-use, and/or other handling to enhance sanitation, protect the content of the dispensing bag, and avoid waste.

DESCRIPTION OF DRAWINGS

The accompanying drawings, which are incorporated in and constitute a part of this specification, illustrate embodiments of the present teachings, and together with the description, serve to explain principles and constructions of the present teachings. Where possible, similar reference numbers may be used to refer to the same or similar elements. In the figures.

DESCRIPTION

Embodiments of the present teachings relate to a food container assembly having a multi-part construction, including a removable internal, disposable but potentially re-usable, enclosure or bag. More particularly, embodiments relate to a re-usable, re-sealable food container assembly in which an internal food storage enclosure and/or disposal bag is located or enclosed within and surrounded by an outer enclosure, cover, or protective case. The internal enclosure or bag and/or outer enclosure or bag can each be made of a sanitary or food-grade material, such as any one or more of silicone rubber, BPA-free plastic, low-density polyethylene (LDPE), and/or other material. The internal and/or external enclosure can likewise be constructed from flexible material, including silicone rubber and/or LDPE, as noted. The use of mutually flexible material can, in aspects, allow the inner enclosure and external enclosure to flexibly conform to each other in terms of volume, shape, and/or contour, thereby permitting the available volume to be more efficiently used or maximized, as well as permitting the child or other user to apply a squeezing action to the food container assembly to extract food product(s) or material. The use of two or more, mutually flexible materials or constructions may also allow the internal enclosure to be flexibly inserted into or extracted from the external enclosure even through a relatively narrow neck and/or other channel or passage, among other benefits. As used herein, it may be noted that in general, "food product", "food product(s)", "food material" or "food material(s)" may refer to solid, semi-solid, soft, and/or liquid product(s) or material, or combinations or blends of such product(s) or materials. Many types and varieties of such product(s) or materials can be stored or dispensed using the food container assembly, such as, merely for instance, baby food, mashes, pulps, purees, soups, juices, fruit, vegetables, milk, cream, and/or other dairy product(s), or others.

The internal and/or external enclosure can likewise in embodiments be made of material that is suitable for refrigeration, freezing, microwave or other cooking, and/or storage or use under other conditions. The internal enclosure may stand in upright position to allow for easy loading of food, liquids or other materials. Reference will now be made to examples of the present teachings, which are illustrated in the accompanying drawings. Where possible the same or similar reference numbers will be used throughout the drawings to refer to the same or like parts.

Figure 1:
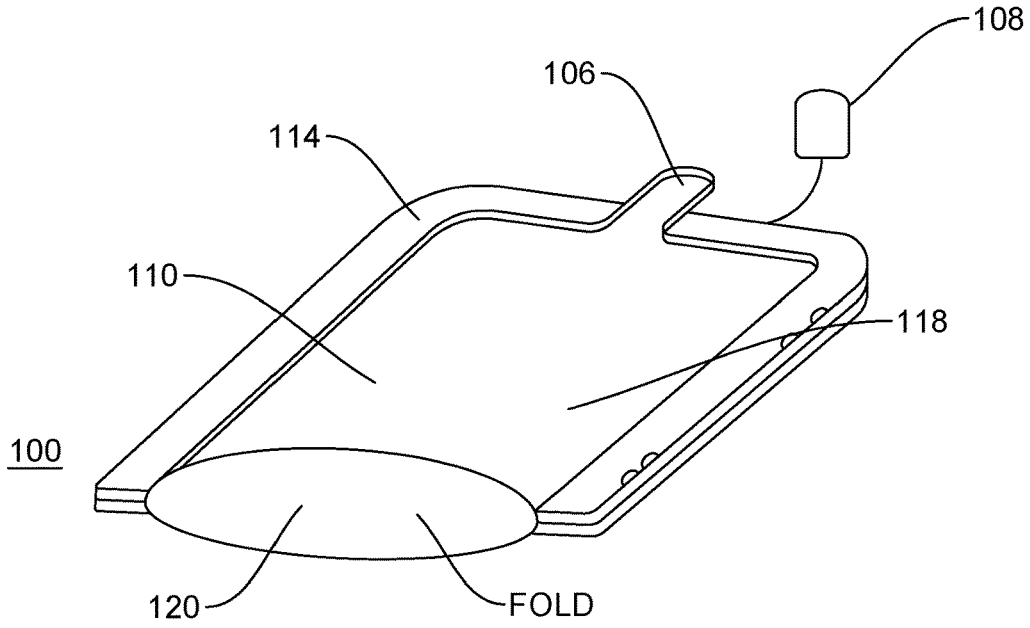
FIG. 1 illustrates an overall food container having a removable internal disposal bag, according to various embodiments.

FIG. 1 illustrates an overall food container assembly 100, according to implementations of the present teachings. In aspects as shown, the food container assembly 100 can be or include a multi-part construction, particularly including a nested or container-within-container arrangement. In general, the food container assembly 100 can include an external enclosure 118, which can serve as an overall cover, bag, sleeve, or enclosure and exterior barrier to provide support, protection, steadying mass, and structural rigidity to the food container assembly 100. The external enclosure 118 can for instance be made of plastic or rubber material, such as for instance silicone rubber, although it will be appreciated that various materials and/or combinations of materials can be used. As noted, the external enclosure 118 (e.g. FIG. 1) can, in general, enclose, cover, surround, protect, and/or otherwise encase an internal enclosure 110 (separately e.g. illustrated in FIG. 2) for internally containing food product. Internal enclosure 100 can in implementations be configured as a flexible bag or container for holding food, liquid(s), or other product(s) or material. The external enclosure 118 can for instance enclose the internal enclosure 110 using a set of snap fit connectors 114, and/or other connections, attachments, seals, fittings, hinges, or mounts which can, for example, fold, squeeze, or compress the external enclosure 118 along a fold line or sealed edge 120 (e.g. FIG. 1) and/or zip enclosure 116 (e.g. FIG. 2) to surround and support the internal enclosure 110 and any food product and/or other material contained in the internal enclosure 110. In implementations as shown, the external enclosure 118 can include a tethered cap 108 to place on an opening 106 to close the overall food container assembly 100, when food product is not being accessed or dispensed. The external enclosure 118 and/or internal enclosure 110 in embodiments can be made of food-grade material, likewise such as silicone rubber, LDPE, and/or other plastic and/or other material and/or insulation. It will be appreciated that either the internal enclosure 110, the external enclosure 118 or both can be constructed from material that is suitable for washing, freezing, defrosting, heating, cooking, and/or other handling or activity. In embodiments, the internal enclosure 110 and/or external enclosure 118 can be made to be reversible. In embodiments, the external enclosure 118 (e.g. FIG. 1) can be made of relatively thin-walled, lightweight, flexible, and/or inexpensive material, such as molded silicone rubber or others, to promote ready removal and substitution of one internal enclosure or other bag for another.

It will be appreciated that the food product itself is contained, stored, or isolated in the internal enclosure 110 and only comes into contact with the side walls and/or other areas or surfaces of the internal enclosure 110 rather than the external enclosure 118. Due in part to that separation, the internal enclosure 110 can be safely removed from the food container assembly 100 by opening the set of snap fits 114 or other connectors or fasteners, to allow the internal enclosure 110 and/or food product stored in the internal enclosure 110 to be removed, replaced, and to possibly clean the internal enclosure 110 and/or external enclosure 118, such as in a dish washer, under running water, or in other manual or automated ways. In embodiments, again, other types of fasteners or connectors rather than snap fits 114 can be used to secure the external enclosure 118 around the internal enclosure 110

Figure 2:
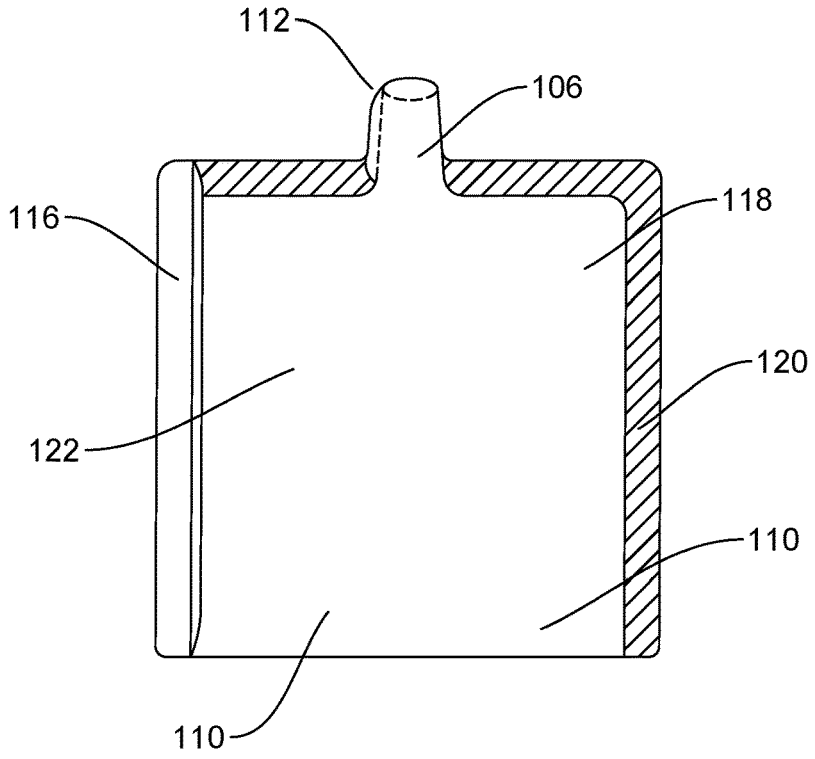
FIG. 2 illustrates aspects of the removable disposal bag, according to various embodiments.

The internal enclosure 110 itself in implementations be opened and the internal storage space, volume, or cavity accessed for instance using a zip closure 116, as for example shown in FIG. 2. In embodiments, the zip closure 116 and/or other sealing mechanism can be constructed to be air-tight, moisture-tight, and/or to provide other degrees or types of sealing action or protection to the interior of the internal enclosure 110. As likewise shown in FIG. 2, the opening 106 can be accessed or opened using a perforated tear line 112 and/or other covering or seal to ensure food freshness or sanitation. A straw or other utensil can be inserted into opening 106, if desired, or fitted to or made integral that opening, as described herein. The internal enclosure 110 can also include a set of sealed edges 120, such as heat-welded or other edges, as likewise shown in FIG. 2. In implementations, the internal enclosure 110 can be provided with a finger loop such as small plastic ring affixed or attached to the outer wall of surface(s) of the internal enclosure 110, to facilitate handling, insertion, and/or extraction or other handling of the internal enclosure 110 in and out of the external enclosure 118. According to implementations, the internal enclosure 110, external enclosure 118, and/or overall food container assembly 100 can be constructed in any of a variety of shapes and sizes, such as for example standard bag sizes (e.g. No. 4, 6, 8, etc.) known in the food, container, and other industries. Likewise, while the food container assembly 100 is illustrated in aspects as being constructed in a generally rectangular shape, in applications, other shapes, such as square, round, oblong, or other regular or irregular shapes, can be used.

Figure 3:
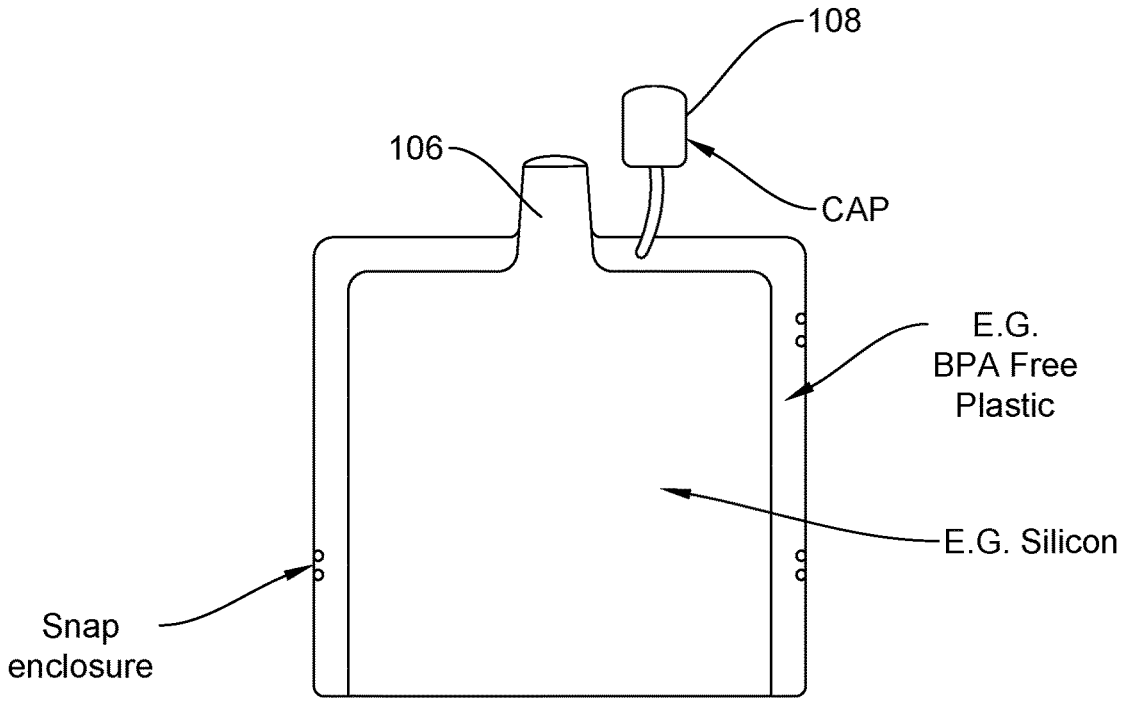
FIG. 3 illustrates aspects of the outer cover, according to various embodiments.

As for instance illustrated in FIG. 3 (front view), once the external enclosure 118 is mounted around the internal enclosure 110 and the set of snap fits 114 and/or other connectors are closed, the internal enclosure 110 and external enclosure 118 cooperate to present and secure the food container assembly 100 in nested, or bag-within-bag configuration for instance for use in dispensing soft food product, including beverages or other liquids, or other material for infants or children, or for storing and dispensing of other types of food product. As noted, the external enclosure 118 can be provided with a tethered cap 108 or other attachment or fitting to close off the opening 106, tethered e.g. by a thin plastic strip, strap, and/or other connection or retainer to preserve food product when the food container assembly 100 is not in use.

Figure 4:
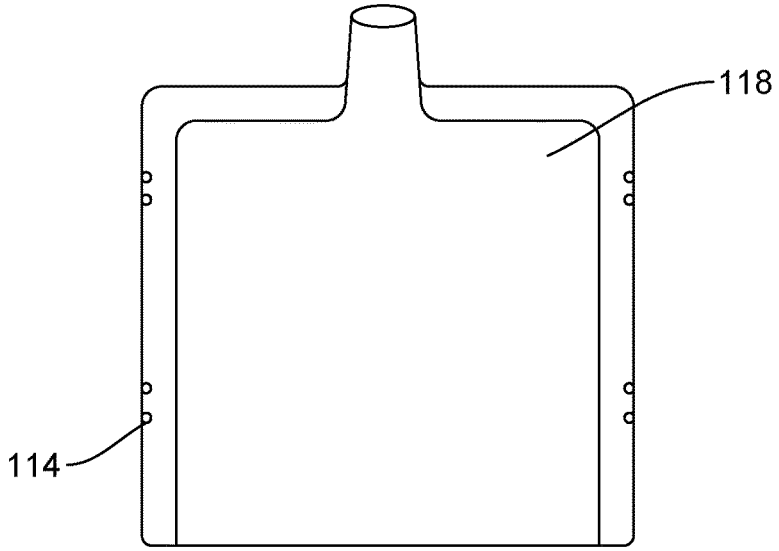
FIG. 4 illustrates aspects of the outer cover in further regards.

FIG. 4 illustrates the assembled food container assembly 100 in a rear view, in which the external enclosure 118 is loaded with and contains dispensable food product or material via the internal enclosure 110. In embodiments, both the internal enclosure 110 and external enclosure 118 can be constructed of transparent plastic or other transparent or translucent material, so that the user can visually identify the type, amount, or condition of food product contained in the food container assembly 100. In embodiments, the internal enclosure 110 and/or the external enclosure 118 can also or instead be marked with lines or striations to visually gauge the amount of food product(s) or material contained in food container assembly 100. If so marked, the marking lines (not shown) can be marked with measurement numbers, such as the approximate number of (liquid or other) ounces of food located in the food container assembly 100. Other units, markings, or gauges can be used In implementations, the internal enclosure 110 and/or external enclosure 118 can be marked with figures or pictures that might be appealing to infants or children, such as familiar animals or others. In embodiments, the internal enclosure 110 and/or external enclosure 118 can also or instead be marked with pictures or indications related to the food product contained in the food container assembly 100, such as pictures of an apple or apples to indicate that the internal enclosure 110 is loaded with apple sauce or another food product containing apples, and so forth. In embodiments, the internal enclosure 110 and/or the external enclosure 118 can also or instead be provided with a markable area, such as an inkable or printable area, legend, or label, for instance, to write or record a child's name, an indication of the food content of the food container assembly 100, date(s), and/or other identifier(s) or information.

The external enclosure 118 also may be insulated with insulating material in order to keep food product either warm or cold for several hours or other periods. Insulation can also be applied via a cavity or air gap between external enclosure 118 and internal enclosure 110 in completed assembly form 100. In embodiments, the external enclosure 118 may also include a slit, compartment, or other area to include an ice pack to keep food product(s) or material, such as food, cooler for longer periods of time.

Figure 5:
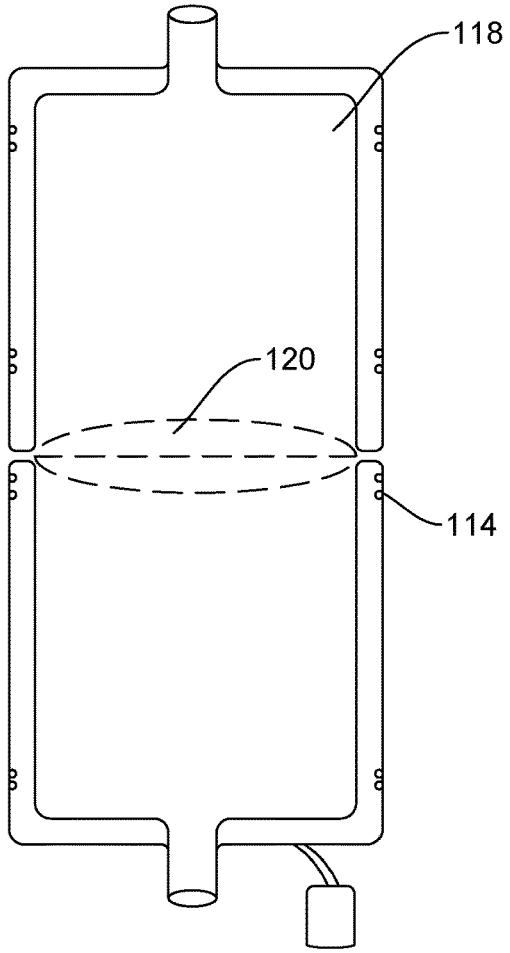
FIG. 5 illustrates aspects of the outer cover in an unfolded state, according to various embodiments.
Figure 6:
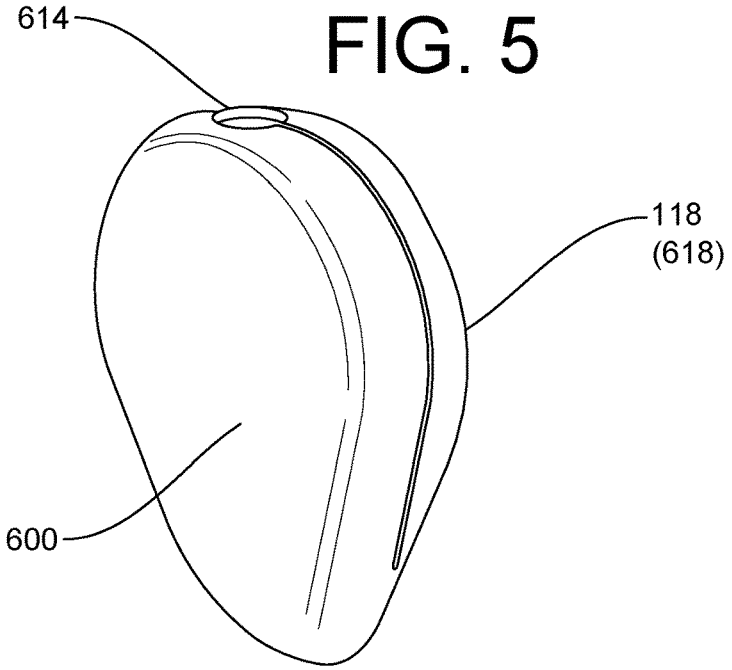
FIG. 6 illustrates an external enclosure, according to various embodiments in further regards.
Figure 7:
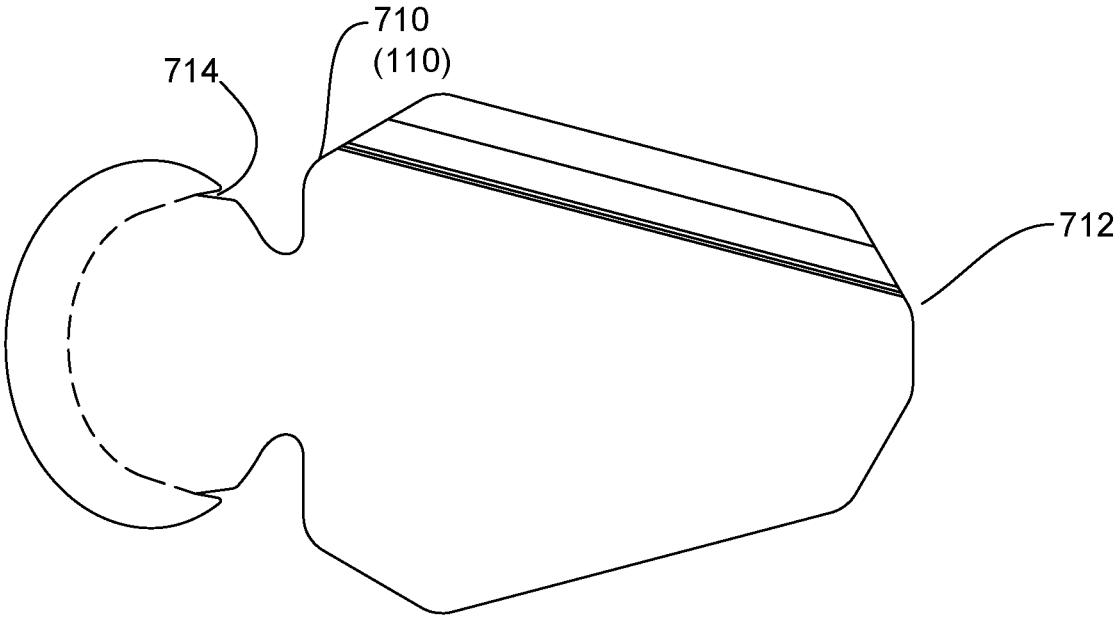
FIG. 7 illustrates an internal enclosure, according to various embodiments in further regards.

As noted, the external enclosure 118 can be constructed in a fold-over configuration, as for instance shown in FIG. 5 (depicting an inside open view, before insertion or sealing of the internal enclosure 110 in the external enclosure 118). While embodiments are shown in that figure in which the fold line is located along a bottom of the external enclosure 118, in embodiments, the fold 120 can be located along a side edge of the external enclosure 118, and/or in other locations.

Additional embodiments of the present teachings are shown in FIG. 6 through 12B. In embodiments as shown in those figures, a food container assembly 600 can include an outer enclosure (e.g. 618, FIG. 6) and an inner enclosure (e.g. 710, FIG. 7). Outer enclosure 618 can be or include an external, molded gag, sleeve, and/or other enclosure, such as a protective enclosure made or molded of silicone rubber and/or other material. The outer enclosure can include slit(s) that open to allow for a wider opening, for instance, for internal enclosure loading and removing. In aspects, the inner enclosure 710 can be or include a flexible bag, such as a food-safe bag made from low-density polyethylene (LDPE) and/or other material. In embodiments where LDPE construction is used, the inner enclosure 710 can allow food material loaded inside the internal enclosure 710 to be frozen without damage to the internal enclosure 710, as well as the food container assembly 600 to be subjected to microwave heating and/or cooking to temperatures of approximately 200 degrees Fahrenheit, although it will be appreciate that other materials can be used.

In aspects, the inner enclosure 710 can in embodiments include a closable seal 712, such as a zip-lock or other type seal, to allow for loading of food, liquid or other material. Similarly, in embodiments the internal enclosure 710 can include a tear-away seam 714, such as a perforated seam allowing a user to tear off an edge or portion of the inner enclosure 710 and separate opposite walls of the inner enclosure 710, such as opposite sides of a LDPE bag. This can, in aspect, allow access to the internal volume or space of inner enclosure 710 and insert or load food products(s) or material, such as baby food, liquids or others. The inner enclosure flexibility allows for user manipulation to allow inner enclosure to be held in place by or through the external enclosure for easy food dispensing.

According to aspects, the use of shapes or configurations as shown can allow the internal enclosure 710 and/or food container assembly 600 as a whole to to be placed in desired positions, such as to stand on edge or side, and facilitate easier or more convenient handling and/or storage, such as in a food pantry or on the shelf of a refrigerator or freezer. According to aspects, the use of flexible materials such as those noted can allow the inner enclosure 710 to flexibly conform to the outer enclosure 618, and for instance increase or maximize the useable volume available to load, store, and/or dispense food product(s) or materials, as compared to rigid or other configurations, as well as make removal, disassembly and cleaning more convenient for the parent or other user. In addition, the use of a flexible nested configuration for food container assembly 600 can promote a more economical use or consumption of food product(s) or material, since the child, parent, and/or other user can grasp and squeeze the food container assembly 600 to extract a high proportion of the food product(s) or material contained therein. Other benefits may obtain, including relatively light weight for handling and use.

Figure 8:
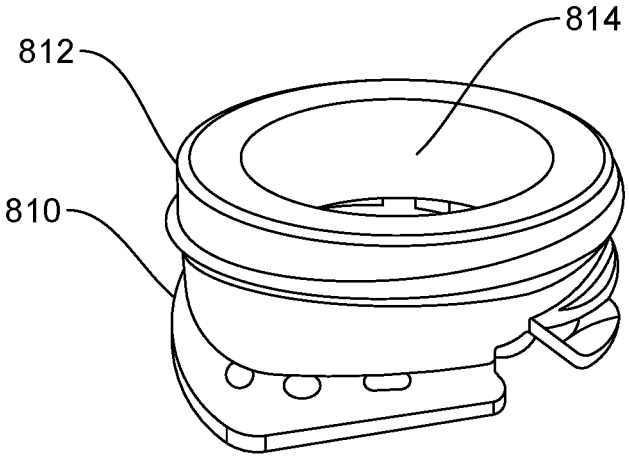
FIG. 8 illustrates a neck assembly according to various embodiments in further regards.

In embodiments as for example illustrated in FIG. 8, the outer enclosure 618 can be configured, fitted, made integral, or equipped with a neck 812 to fit into and seal, cap, and/or attach to opening 814 in the outer enclosure 618 or similar. In embodiments, the neck 812 can be or include a two-part, screw neck, having an upper (male) portion which screws down onto a receiving female portion but it will be appreciated that other types of mechanical attachment or registration can be used. In aspects, neck 812 can be or include a receiving portion (again having e.g. a female helical thread) and a top portion (again having e.g. a mating, male helical thread). In implementations, as shown, the receiving or lower (female threaded) portion can be snapped together or unsnapped accordingly, using for example a protruding tab registering with an opposite, corresponding groove, or tongue-and-groove connection. Other configurations of neck 812 and associated parts or member are possible.

In aspects, the top (or detachable) portion of the neck 812 can be screwed down to seal opening 614, unscrewed to open the opening 614, and/or manipulated in other ways to perform other actions. Additionally, screw cap 812 can be fused or made integral with external enclosure 614 or similar In embodiments, for example as shown in FIGS. 9 through 12A, various attachments, fittings, and/or other elements or members may be provided for example to provide various utensils, caps, tools, safety devices, and/or other elements or features. In embodiments, those fittings or attachments can be screwed onto or otherwise attached to neck 812 and/or other elements of the food container assembly 600. For example, and as described herein, the food container assembly 600 can be provided with a spoon-type utensil (e.g. shown in FIG. 9) to allow a user to more conveniently access and consume soft food product(s) or materials such as baby food, mashes, or fruit or vegetable pulps, and/or in embodiment can be provided with a straw or "sip tip" or similar or other spout type attachment (e.g. shown in FIG. 12) to permit convenient drinking or consumption of liquid or near-liquid product(s) or materials. Other attachments or utensils are possible, It will be appreciated that according to implementations, various caps, utensils, and/or other fittings or attachments can be interchangeable or replaceable with other such caps, utensils, fittings or attachments, in modular fashion.

Figure 9:
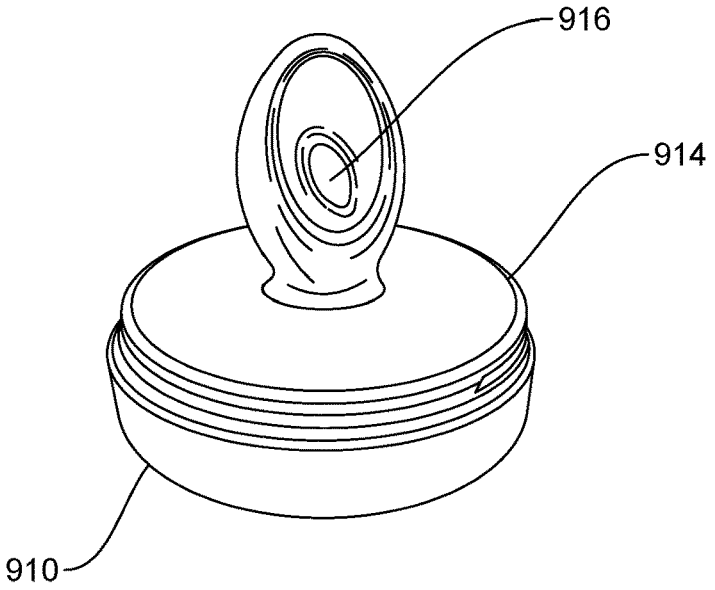
FIG. 9 illustrates a spoon assembly that can be used in various embodiments in further regards.
Figure 10A:
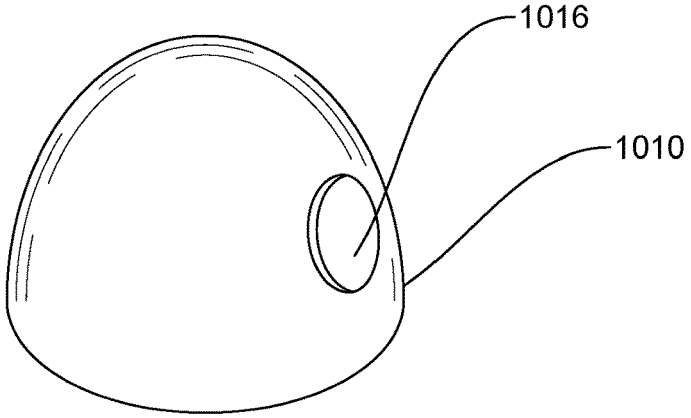
FIG. 10A illustrates a cap that can be used with a spoon or spout assembly in various embodiments in further regards.
Figure 10B:
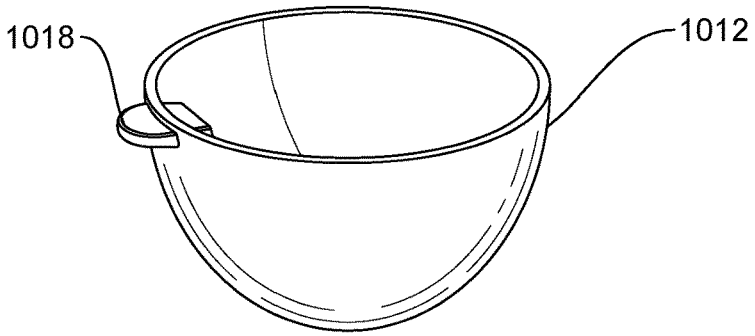
FIG. 10B illustrates a tabbed cap that can be used with a spoon or spout assembly in various embodiments in further regards.
Figure 11:
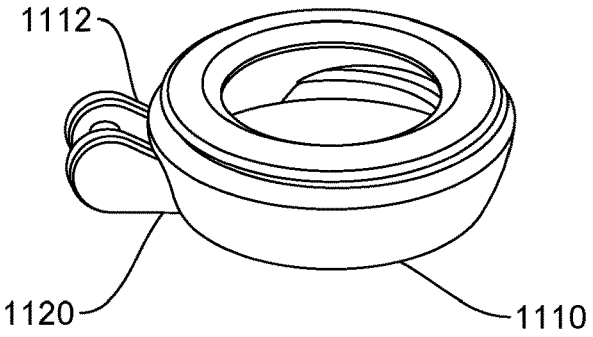
FIG. 11 illustrates a sip tip or spout screw cap that can be used with a sip tip assembly in various embodiments in further regards.

In the case of a spoon attachment 914 as shown in FIG. 9, the spoon attachment 914 can, in embodiments, be constructed integrally with a neck 910, which can be or include a neck member similar to neck 810 or others. The flat surface of the spoon utensil can be configured with a relief hole 916, although it will be appreciated that the size and location or area of relief hole 916 can vary from the exact size, location or area shown. When a spoon attachment 914 is provided, the food container assembly 600 can if desired likewise be provided with a protective cap or covering, such as a cap 1010 shown in FIG. 10A or a tabbed spoon cap 1012 shown in FIG. 10B. In the case of a cap 1010 as shown in FIG. 10A, the cap 1010 can be or include a flexible dome, such as a molded silicone dome, which can be grasped or pinched to cause the cap 1010 to flex, and permit the cap 1010 to be placed onto or removed from neck 914, and therefore expose or cover the spoon attachment 914. If desired, a tabbed cap 1012 (FIG. 10B) can be provided which includes a small protruding tab 1018, to facilitate grasping and manipulation of the tabbed cap 1012.

Figure 12:
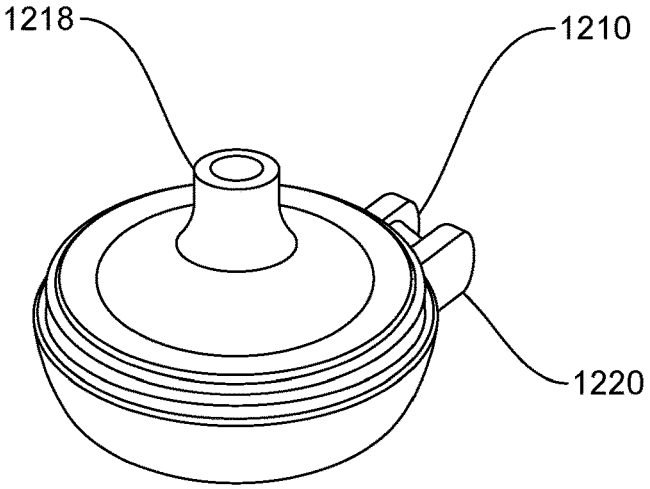
FIG. 12 illustrates a sip tip or spout assembly that can be used in various embodiments in further regards.

As noted, in embodiments the food container assembly 600 can be provided with a sip tip or spout, as for instance a sip tip member 1210 shown in FIG. 12. When provided, the sip tip 1210 can provide the user with a straw-like or spout sip member 1218, to draw liquid, soft foods, or other product(s) or material from food container assembly 600.

Figure 13:
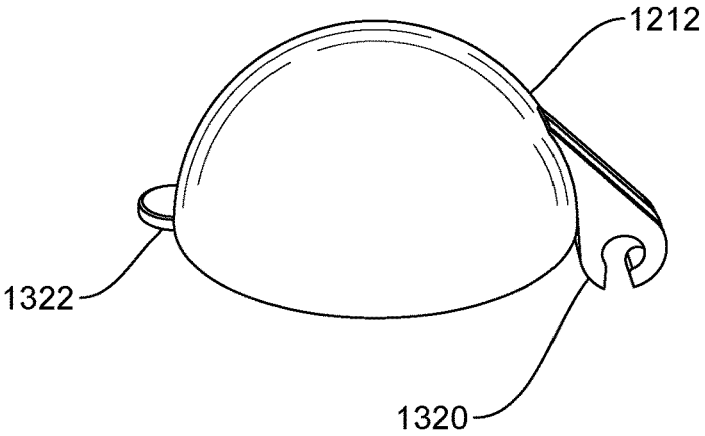
FIG. 13 illustrates a cap that can be used with a sip tip or spout assembly in various embodiments in further regards.

When provided, the sip tip member 1210 can be enclosed and protected by a cap 1312 such as shown in FIG. 13, which can for example be hingeably connected to hinge 1220 (or 1120) of sip tip screw cap 1112 using a mating hinge 1320. If desired, the sip tip cap 1212 can likewise be provided with a tab 1322, to facilitate grasping and manipulation of sip tip cap 1212, and the taking off and on of that cap to permit access to and use of the sip tip 1218.

Figure 14:
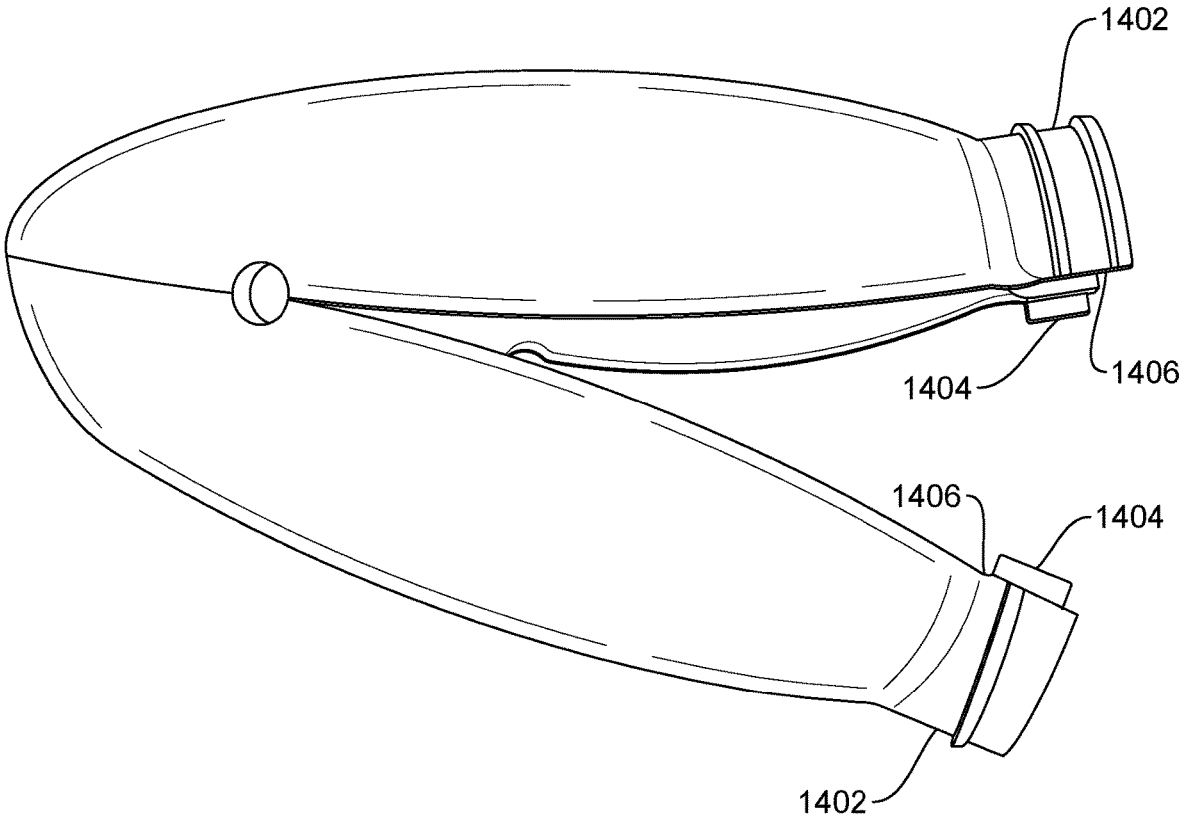
FIG. 14 illustrates a cap member having a snap-together assembly and a slit on each side, according to various aspects.
Figure 15:
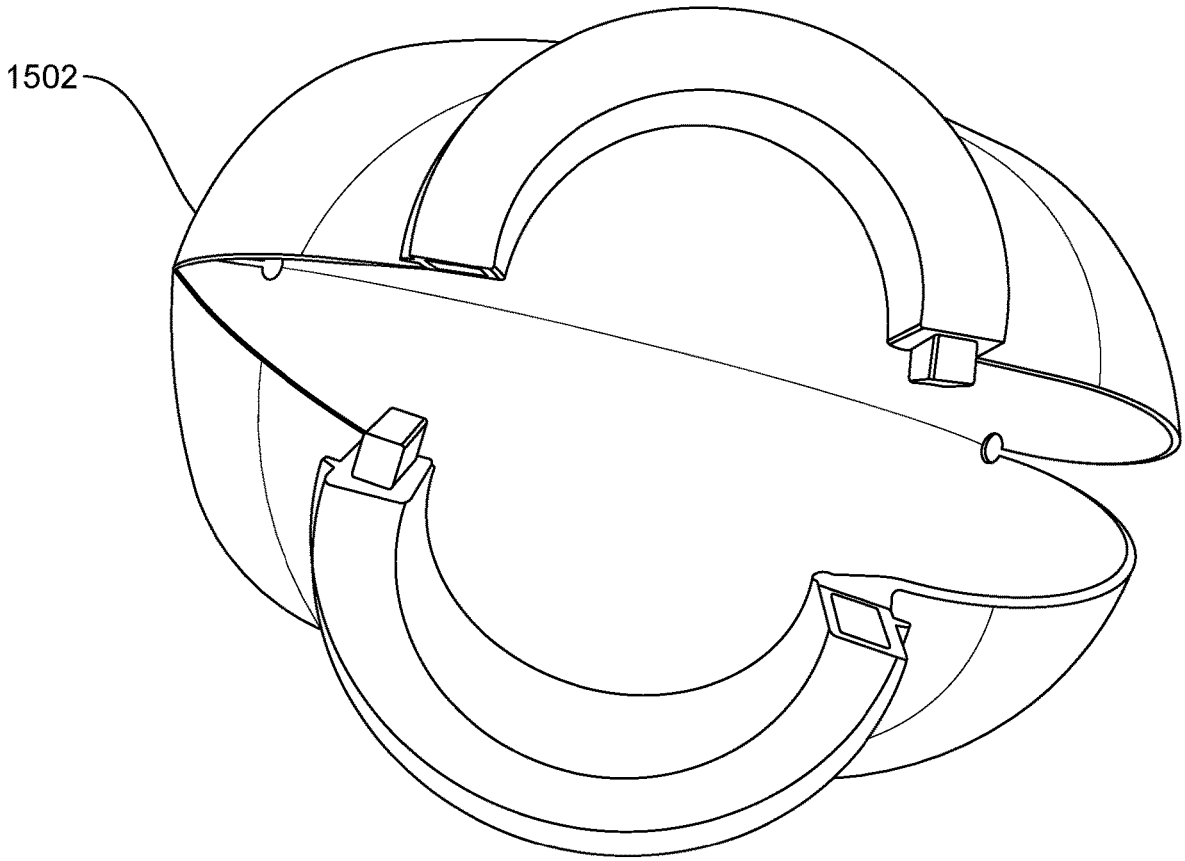
FIG. 15 illustrates a cap member having a snap-together assembly with male and female components, according to further various aspects.

According to various implementations, a screw-down or other spout or neck assembly can be provided a part of or integral to the external enclosure, for example as a snap-together screw-down cap 1402, as shown for instance in FIGS. 14 and 15, which can be constructed as snap-together male (1404) and female (1406) parts, by which opposite sides of the external enclosure 1502 can be snapped together to allow a cap or other member to be attached to the neck and spout area of the external enclosure or bag. Other manners of connecting a spout or neck member of the external bag can be used to close the slits or openings on the external enclosure.

The foregoing description is illustrative, and variations in configuration and implementation may occur to persons skilled in the art. For example, while embodiments have been described in which the food container assembly 100 includes one internal enclosure 110 nested, enclosed, or contained in the external enclosure 118, in embodiments, two or more of food container assembly 100 can be nested or inserted within one external enclosure 118, for instance, to allow for selection or dispensing of two or more alternative food products from the same food container assembly 100. Similarly, in embodiments multiple exterior covers in the form of external enclosure 118 or otherwise can be provided. Further, while aspects of the internal enclosure 110 and external enclosure 118 have been described or illustrated as being constructed of single-ply plastic, rubber, or other material, in embodiments, either or both of the disposal bag 110 and external enclosure 118 can be fabricated from multi-ply layers or materials, for instance, to supply greater insulation effects or to increase resistance to puncturing or other damage.

Other parts or constructions described as singular or integrated can in embodiments be plural or distributed, and resources described as multiple or distributed can in embodiments be combined. The scope of the present teachings is accordingly intended to be limited only by the following claims.

What is claimed is:

1. A container, comprising:

an openable, resilient, external enclosure; and a sealable internal enclosure, configured to— be closably sealed and received and flexibly enclosed within the external enclosure, and flexibly conform to the external enclosure, the internal enclosure comprising an opening to allow consumption of food material contained in the internal enclosure while contained in the external enclosure; and an air gap between the external enclosure and internal enclosure permitting insulation of the internal enclosure, wherein the external enclosure further comprises— a bifurcated neck having a cap, the bifurcated neck comprising male and female parts adapted to snap together, the cap having a screw-down construction and being adapted to engage with external surfaces of the bifurcated neck to hold and seal the internal enclosure within the external enclosure, and at least one slit formed in a side of the resilient external enclosure extending from the bifurcated neck adapted to allow wider opening of one or more portions of the bifurcated neck, the at least one slit being terminated in a rounded stress relief opening to prevent tearing damage to the external enclosure when opened, the external enclosure acting to provide a bias on the bifurcated neck when hingedly moved for access to the internal enclosure.

2. The container of claim 1, wherein the cap comprises a spoon utensil formed in the cap.

3. The container of claim 1, wherein the cap comprises a straw utensil formed in the cap.

4. The container of claim 1, wherein the cap comprises a fork utensil formed in the cap.

5. The container of claim 1, wherein the cap comprises a tethered cap.

6. The container of claim 1, wherein the cap comprises a rotationally engaged external structure which seals the internal enclosure to at least one portion of the external enclosure allowing fluid communication between the internal enclosure and the cap for directing the flow of the food material during dispensing through the cap.

7. The container of claim 1, wherein the internal enclosure comprises a perforated tear-away seam to permit separation of opposite walls of the internal enclosure.

8. The container of claim 1, wherein the internal enclosure comprises a zip-lock seal.

9. The container of claim 1, wherein the cap comprises interchangeable spouts or utensils.

10. The container of claim 1, wherein the internal enclosure is configured to permit food material to be loaded through a zip lock portion of the internal enclosure.

11. A method of loading a container with food product, comprising:

providing an openable, resilient, external enclosure; and providing a sealable internal enclosure, configured to— be closably sealed and received and flexibly enclosed within the external enclosure; and flexibly conform to the external enclosure, the internal enclosure comprising an opening to allow consumption of food material contained in the internal enclosure while contained in the external enclosure;

providing an air gap between the external enclosure and internal enclosure permitting insulation of the internal enclosure; and loading the food material in the internal enclosure, wherein the external enclosure further comprises— a bifurcated neck having a cap, the bifurcated neck comprising male and female parts adapted to snap together, the cap having a screw-down construction and being adapted to engage with external surfaces of the bifurcated neck to hold and seal the internal enclosure within the external enclosure, and at least one slit formed in a side of the resilient external enclosure extending from the bifurcated neck adapted to allow wider opening of one or more portions of the bifurcated neck, the at least one slit being terminated in a rounded stress relief opening to prevent tearing damage to the external enclosure when opened, the external enclosure acting to provide a bias on the bifurcated neck when hingedly moved for access to the internal enclosure.

12. The method of claim 11, wherein the cap comprises a spout or utensil formed in the cap.

13. The method of claim 11, wherein the internal enclosure comprises a perforated tear-away seam to permit separation of opposite walls of the internal enclosure to permit dispensing of the food material inside the internal enclosure.

* * * * *